United States Patent [19]
Amano et al.
[11] 4,440,147
[45] Apr. 3, 1984

[54] ROOM-HEATING STOVE WITH A RETRACTABLE FIRE-PREVENTION SPACER

[75] Inventors: Kazunori Amano; Bunji Aizawa; Akio Ibe; Yoichi Sekikawa, all of Niigata, Japan

[73] Assignees: Toshiba Netsukigu Kabushiki Kaisha, Nigata; Shin Toa Koeki Kabushiki Kaisha, Tokyo, both of Japan

[21] Appl. No.: 395,713

[22] Filed: Jul. 6, 1982

[30] Foreign Application Priority Data

Jul. 10, 1981 [JP] Japan ..... 56-102491[U]

[51] Int. Cl.[3] ..... F24C 15/36

[52] U.S. Cl. ..... 126/201; 126/202; 126/92 B; 219/347

[58] Field of Search ..... 126/298, 201, 202, 203, 126/92 R, 92 AC, 92 B, 217, 42, 92 A; 431/33, 34, 88; 219/347, 358, 342; 34/4; 237/52, 79

[56] References Cited

U.S. PATENT DOCUMENTS

| | | | |
|---|---|---|---|
| 1,294,941 | 2/1919 | Nicolaus | 126/202 |
| 1,498,498 | 6/1924 | Webb | 126/202 |
| 2,234,373 | 3/1941 | Gough | 219/342 |
| 2,612,594 | 9/1952 | Schubert et al. | 219/358 |
| 2,878,361 | 3/1959 | Steber | 219/347 |
| 4,314,543 | 2/1982 | Bullington | 126/201 |

FOREIGN PATENT DOCUMENTS

| | | | |
|---|---|---|---|
| 772606 | 4/1957 | United Kingdom | 126/201 |
| 861352 | 2/1961 | United Kingdom | 126/201 |

*Primary Examiner*—James C. Yeung
*Attorney, Agent, or Firm*—Stevens, Davis, Miller & Mosher

[57] ABSTRACT

A reflection-type oil stove comprises a burner assembly mounted in a generally boxlike stove body, and a concave reflector behind the burner assembly for converging the heat produced thereby. In order to hold the stove body safely distanced from any external object that may be burnt by the converged heat, a safety spacer is attached to the front edge of a drip pan, forming the bottom of the stove body, for pivotal motion between a recumbent working position and an upstanding retracted position. Generally in the shape of a flat plate, the safety spacer lies flat against the floor when in the working position under the bias of a spring. When in the retracted position, on the other hand, the safety spacer conceals a heat control knob on the stove body, making it impossible for the user to operate the stove unless the safety spacer is in the working position.

6 Claims, 5 Drawing Figures

ROOM-HEATING STOVE WITH A RETRACTABLE FIRE-PREVENTION SPACER

BACKGROUND OF THE INVENTION

This invention relates to room-heating devices, and more specifically to an oil stove of the reflection type. Still more specifically, the invention deals with means in such a room-heating stove for holding the same at a safe distance from any external article, such as a piece of furniture, so as not to burn or scorch the article.

Reflection-type oil stoves are in widespread use. In this type of stove a concave reflector lies behind a burner assembly for reflecting and converging its heat forwardly of the stove. Should the stove be held too close to furniture, walls, etc., the converged heat might scorch or burn such an article, possibly resulting in a fire in the worst case.

In order to preclude this danger, it has been suggested to extend forwardly the drip pan fastened to the bottom of the stove body. The forward extension of the drip pan serves as a fire-prevention spacer. Even if the user attempts to place the stove too close to some external article, the drip pan extension prevents this and holds the stove body at such a distance from the article that the latter will not easily burn even if it is exposed to the concentrated heat for any extended length of time.

However, the stove with such a forward drip-pan extension requires an undue space when packaged in a box. The reduction of the packaging space is possible, of course, by detaching the drip pan from the stove body, but then the user must fasten the pan to the body preparatory to the use of the stove.

A solution to this problem is found in Japanese Utility Model Application No. 54781/1980, laid open to public inspection as No. 155204/1981 on Nov. 19, 1981. The application proposes the use of a metal rod formed generally into the shape of "U". The opposite ends of the U-shaped rod are pivotally attached to both sides of the body of a reflection-type oil stove. In the use of the stove, the U-shaped rod is manually turned forwardly and held resting on the floor under its own weight. The distal end of the U-shaped rod, extending along the front face of the stove is slightly raised from the floor to hold any external object at a burn-free distance from the stove body. The stove can also be compactly received in a packaging box by having the U-shaped rod turned upwardly and held against the stove body.

However, the device of this prior art has several drawbacks severely restricting its practical utility. For example, walking just in front of the stove, a person may catch the foot against the rod and may himself stagger or fall or may deform the rod or even upset the stove because the rod is raised from the floor.

An additional drawback is that even when held raised against the stove body, the U-shaped rod allows access to a control knob on the front panel of the body. These possibilities become still higher because the U-shaped rod rests on the floor under its own weight. Thus the user may operate the stove with the rod in the retracted position. In that case the rod will not perform its intended function at all.

SUMMARY OF THE INVENTION

It is an object of this invention, in view of the noted drawbacks of the prior art, to provide a room-heating stove with improved means for affording a safe, burn-free distance between the stove body and any external matter.

According to this invention, there is provided a room-heating stove having a safety spacer mounted on the bottom end of the body, on its front side, for pivotal motion between a recumbent working position and an up-standing retracted position. Generally in the form of a flat plate, the safety spacer is held flat against the floor when in the working position. Also included is a spring or equivalent means for biasing the safety spacer from the retracted toward the working position.

One of the advantages of the invention over the prior art, as advocated by the mentioned Japanese utility model application, resides in the planar shape of the safety spacer. Lying flatwise against the floor in its working position, the safety spacer offers no danger at all of catching the feet of walkers. This danger becomes all the more absent because the safety spacer positively stays in the working position under the bias of the spring or the like, instead of under its own weight. The safety spacer is not to deform, moreover, even if treated.

In a preferred embodiment the room-heating device of this invention takes the form of a reflecting oil stove, having a heat control knob and other control means on its front panel. The safety spacer in this particular adaptation conceals at least the heat control knob when pivoted upwardly to the retracted position. The user is therefore incapable of operating the stove without letting the safety spacer fall to the working position.

The above and other features and advantages of this invention and the manner of attaining them will become more apparent, and the invention itself will best be understood, from a study of the following description of the preferred embodiment illustrated in the attached drawings.

DESCRIPTION OF THE PREFERRED EMBODIMENT

Figure 1:
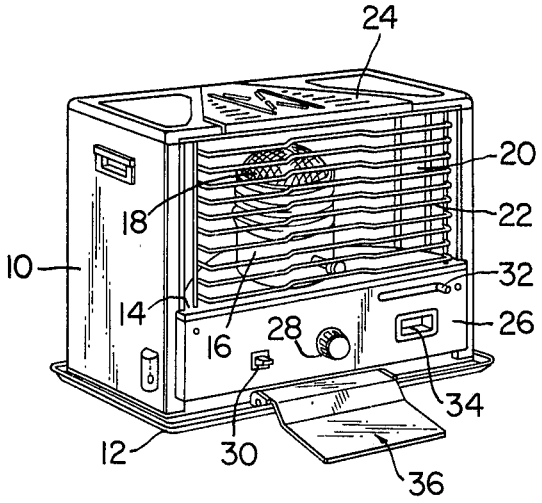
FIG. 1 is a view in perspective of the reflection-type oil stove constructed in accordance with the principles of the present invention.

The invention will now be described in detail as embodied in a reflection-type oil stove shown in its entirety in FIG. 1. The oil stove has a generally box-like, upstanding body 10 having a drip pan 12 fastened to its bottom. The stove body 10 with the drip pan 12 is to be placed directly on the floor in use.

The stove body 10 has its front side recessed to provide an offset or ledge 14. Disposed centrally on this offset is a burner assembly 16 in the shape of an upstanding cylinder topped by a wire net dome 18. As is well known, the burner assembly in this type of stove encloses a tubular wick, not shown, which draws the fuel oil to be burnt and which is movable vertically out of and back into its holder or socket, also not shown, to control the heat output of the stove. A concave reflector 20 lies behind the burner assembly 16 to reflect and converge its heat in front of the stove body 10. An openable grille 22 covers the front of the burner assembly 16 to prevent inadvertent access thereto during heat production. Overlying the burner assembly 16 is an apertured to plate 24 to allow some hot gases of combustion to flow upwardly therethrough.

Just under the offset the stove body 10 has a front panel 26 on which there are mounted various controls to be manipulated by the user for operating the stove, as hereinafter set forth. In the central portion of the front panel there is disposed a heat control knob 28 for moving the unshown wick up and down within the burner assembly 16. Located to the left, as seen in FIG. 1, of the heat control knob 28 is an ignition lever 30 for setting fire to the wick. An extinction lever 32 lies at the extreme right of the front panel 26 for the immediate extinction of the burner assembly 16. Seen just under the extinction lever is a peephole 34 for visual observation of the amount of fuel oil in the fuel tank, not shown, enclosed in the stove body 10.

In accordance with a feature of this invention a fire-prevention or safety spacer is pivotally mounted at the bottom end and on the front side of the stove body 10, as generally identified by the reference numeral 36. The safety spacer 36 in this particular adaptation of the invention is attached to the front end of the drip pan 12 which substantially forms the bottom of the stove body.

Figure 2:
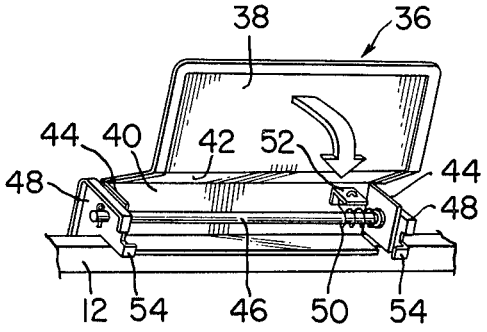
FIG. 2 is an enlarged view in perspective of the safety spacer and means associated therewith in the oil stove of FIG. 1, showing the safety spacer in its upstanding retracted position.
Figure 3:
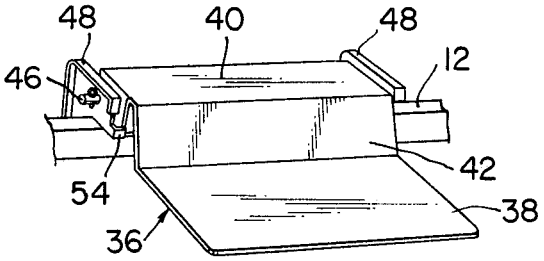
FIG. 3 is a view similar to FIG. 2, showing the safety spacer in its recumbent working position.

FIGS. 2 and 3 are more detailed representations, on an enlarged scale, of the safety spacer 36 and means closely associated therewith. FIG. 2 shows the safety spacer 36 in an upstanding, retracted position whereas FIG. 3 shows the spacer in a recumbent, working position. It will be observed from these figures that the safety spacer 36 integrally comprises: (a) a main portion 38 in the shape of a flat, rectangular plate; (b) a base portion 40 laid parallel to the main portion; and (c) a sloping connective portion 42 serving to interconnect the main and base portions.

The base portion 40 of the safety spacer has a pair of lugs 44 turned downwardly or rearwardly from its opposite lateral ends. These lugs are rotatably mounted on a shaft 46 extending horizontally between another pair of lugs 48 fixedly mounted on the front, top edge of the drip pan 12. Thus is the safety spacer pivotable between the retracted position of FIG. 2 and the working position of FIG. 3.

Another feature of the invention resides in a restoring spring 50, FIG. 2, biasing the safety spacer 36 from the retracted position toward the working position. In the illustrated embodiment the restoring spring takes the form of a torsion spring coiled around the shaft 46. One end of the torsion spring is anchored to a spring retainer 52 affixed to the rear or lower surface of the base portion 40 of the safety spacer.

FIG. 2 also reveals a pair of stops 54 formed integral with the pair of fixed lugs 48, respectively, on the drip pan 12. Upon pivotal motion of the safety spacer 36 from the retracted position toward the working position under the bias of the restoring spring 50, the stops 54 engage with the pair of movable lugs 44 on the safety spacer, thus retaining the same in the working position. The safety spacer when thus stopped in the working position has its main portion 38 in copolanar relation with the bottom of the drip pan 12.

Figure 4:
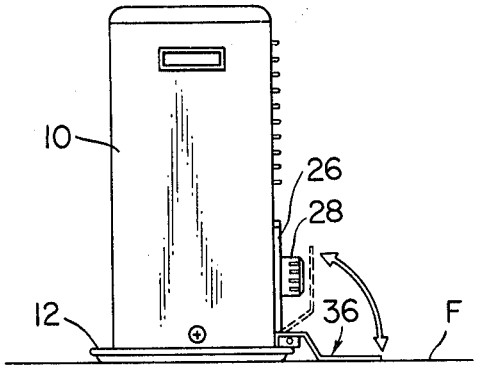
FIG. 4 is a side elevation of the oil stove of FIG. 1, with the safety spacer shown in the working position.

Such being the construction of the reflection-type oil stove embodying the principles of the invention, it will be seen that when the stove is installed on the floor F as in FIG. 4, the safety spacer 36 occupies the recumbent working position under the force of the restoring spring 50. The safety spacer when in this working position functions to maintain a burn-free distance between the stove body 10 and any external object such as furniture or walls of the room. The front-to-rear depth dimension of the safety spacer depends upon the maximum calorific value of the heat produced by each particular stove with which it is incorporated. With this dimension suitably determined, therefore, the safety spacer will serve to prevent the stove from burning or scorching the external article even when the latter is placed in abutting contact with the spacer.

Particular attention is called to the shape of the safety spacer 36 and to the restoring spring 50. Since the main portion 38 of the safety spacer is exactly flat and is sprung into close contact with the floor F, it offers no possibility of catching the foot of a person walking on the floor. Nor will it deform even when treaded accidentally.

Figure 5:
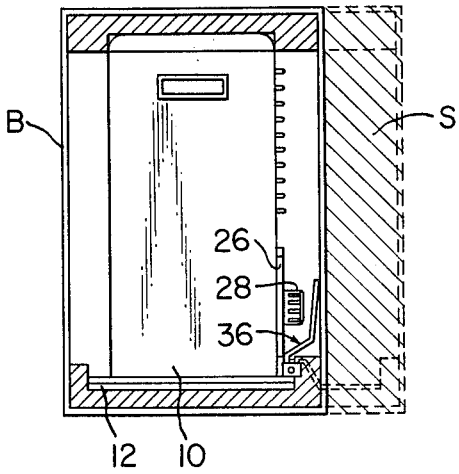
FIG. 5 is a view similar to FIG. 4 showing the oil stove packaged in a box, with the safety spacer in the retracted position.

FIG. 5 shows the oil stove of this invention packaged in a box B for shipment. During insertion into the box B from above, the stove will have its safety spacer 36 turned upwardly against the bias of the restoring spring 50 in sliding contact with one of the walls of the box. The safety spacer need not be manipulated during packaging. Once the stove is bottomed in the box, moreover, the safety spacer will stay in the upstanding retracted position, as drawn, in abutting engagement with an inside surface of the box. The hatched portion designated S in FIG. 5 indicates the space saved by the retraction of the safety spacer. It will be understood that the packaging box would have to be much larger if the drip pan 12 were extended forwardly instead of the use of the retractable safety spacer.

Upon withdrawal of the stove from within the box B the safety spacer 36 will automatically turn downwardly to the working position by the effect of the restoring spring 50. The user need not manipulate the spacer in the use of the stove.

The safety spacer 36 in accordance with the invention has an additional advantage arising from its plate form. When in the retracted position it hides at least the heat control knob 28 on the front panel 26 of the stove body 10. This makes it impossible for the user to operate the stove with the safety spacer somehow held retracted, thus contributing to the greater safety of the stove.

Although the invention has been shown and described as embodied in a reflection-type oil stove, it is recognized that the invention principles find application to other types of room-heating devices. In such adaptations of the invention, moreover, various modifications and variations may be restored to within the broad teaching hereof.

What is claimed is:

1. A room-heating stove comprising:

(a) a body adapted to stand on a floor;

(b) means in the body for producing heat directed forwardly of the body;

(c) a safety spacer mounted on the bottom end of the body, on its front side, for pivotal motion between a recumbent working position, for holding any external object a safe distance away from the body so as not to be burnt by the heat-producing means, and an upstanding retracted position for saving space when the stove is packaged, the safety spacer being largely in the shape of a flat plate so as to be held flat against the floor when in the working position; and (d) means for urging the safety spacer from the retracted position toward the working position.

2. The room-heating stove according to claim 1, further comprising stop means for holding the safety spacer in the recumbent working position aganst the force of the urging means.

3. A room-heating reflection-type oil stove comprising:

(a) a body adapted to stand on a floor;

(b) a burner assembly in the body for producing heat;

(c) a reflector behind the burner assembly for reflecting and converging the heat in front of the body;

(d) control means on a front face of the body for operating the stove; and (e) a safety spacer mounted on the bottom end of the body, on its front side, for pivotal motion between a recumbent working position, for holding the body a safe distance away from any external object so as not to burn the latter with the converged heat, and an upstanding retracted position for saving space in packaging, the safety spacer being generally in the shape of a flat plate so as to lie flat against the floor when in the working position and to conceal at least some of the control means on the body when in the retracted position.

4. The room-heating reflection-type oil stove according to claim 3, wherein the body has a drip pan forming its bottom, and wherein the safety spacer is pivotally attached to the front edge of the drip pan.

5. The room-heating reflection-type oil stove according to claim 3, further comprising spring means for biasing the safety spacer from the retracted toward the working position.

6. The room-heating reflection-type oil stove according to claim 5, further comprising stop means for retaining the safety spacer in the working position against the bias of the spring means.

* * * * *